US009016016B2

(12) United States Patent
Den Adel

(10) Patent No.: US 9,016,016 B2
(45) Date of Patent: Apr. 28, 2015

(54) INSULATED PERIMETER ROOF CURB

(71) Applicant: Duane G Den Adel, Langley, WA (US)

(72) Inventor: Duane G Den Adel, Langley, WA (US)

( * ) Notice: Subject to any disclaimer, the term of this patent is extended or adjusted under 35 U.S.C. 154(b) by 0 days.

(21) Appl. No.: 14/196,923

(22) Filed: Mar. 4, 2014

(65) Prior Publication Data

US 2015/0068133 A1 Mar. 12, 2015

Related U.S. Application Data

(60) Provisional application No. 61/772,190, filed on Mar. 4, 2013.

(51) Int. Cl.

| | |
|---|---|
| ***E04H 12/00*** | (2006.01) |
| ***E04D 13/16*** | (2006.01) |
| ***E04B 1/66*** | (2006.01) |
| ***E04B 1/76*** | (2006.01) |
| ***E04D 13/04*** | (2006.01) |
| ***E04H 17/22*** | (2006.01) |
| ***E04D 13/15*** | (2006.01) |

(52) U.S. Cl.

CPC ..... *E04D 13/1687* (2013.01); *E04B 1/665* (2013.01); *E04B 1/7654* (2013.01); *E04D 13/0445* (2013.01); *E04D 13/0459* (2013.01); *E04D 13/1668* (2013.01); *E04H 17/22* (2013.01); *E04D 13/15* (2013.01)

(58) Field of Classification Search

CPC ..... E04D 13/1687; E04D 13/1668; E04D 13/0459; E04D 13/0445; E04D 13/1625; E04D 13/12; E04D 13/0315; E04B 1/665; E04H 17/22; E04H 12/12

USPC ..... 52/300, 200, 11, 73, 481.1, 94–96, 52/404.1

See application file for complete search history.

(56) References Cited

U.S. PATENT DOCUMENTS

| | | | | |
|---|---|---|---|---|
| 3,807,110 | A | 4/1974 | Kaminski | |
| 5,647,175 | A * | 7/1997 | Smyth | 52/58 |
| 5,678,381 | A * | 10/1997 | DenAdel | 52/836 |
| 5,896,711 | A | 4/1999 | McClure | |
| 5,921,053 | A * | 7/1999 | Callahan et al. | 52/843 |
| 6,067,759 | A | 5/2000 | House | |
| 6,151,838 | A | 11/2000 | Husein | |
| 7,065,928 | B1 | 6/2006 | Lane | |

(Continued)

FOREIGN PATENT DOCUMENTS

| | | |
|---|---|---|
| CA | 795138 | 9/1968 |
| CA | 2261441 | 5/2000 |

(Continued)

*Primary Examiner* — Brian Glessner
*Assistant Examiner* — Paola Agudelo
(74) *Attorney, Agent, or Firm* — Thomas E. Loop

(57) ABSTRACT

An innovative insulated perimeter curb positioned along the perimeter of a roof, a deck, or other like platform structure is disclosed herein. The insulated perimeter curb is generally comprised of an upwardly facing U-shaped sheet metal receiving track fastened along the perimeter of the roof or deck. The receiving track includes a bottom web and a pair of spaced apart and upwardly extending sidewalls. The receiving track retains and holds a composite beam. In addition, a sheet metal cap (e.g., flat stock or C-shaped stud) is generally positioned on top of the composite beam. The innovative perimeter curb enables (i) the quick and integral construction of a temporary safety rail system, (ii) the construction of a concealed gutter system, and (iii) the construction of a cantilevered curb.

13 Claims, 6 Drawing Sheets

(56) References Cited

U.S. PATENT DOCUMENTS

| | | | | |
|---|---|---|---|---|
| 7,493,729 | B1 | 2/2009 | Semmes | |
| 8,381,451 | B1 * | 2/2013 | Demchak et al. | 52/60 |
| 2007/0113506 | A1 * | 5/2007 | Denadel | 52/481.1 |
| 2009/0260310 | A1 | 10/2009 | DenAdel | |
| 2010/0139186 | A1 | 6/2010 | Laremore | |

FOREIGN PATENT DOCUMENTS

| | | | |
|---|---|---|---|
| CA | 2280222 | | 7/2000 |
| GB | 143585 | | 5/1920 |
| GB | 2180566 | | 4/1987 |
| WO | 2004063632 | A2 | 7/2004 |

* cited by examiner

INSULATED PERIMETER ROOF CURB

CROSS-REFERENCE TO RELATED APPLICATIONS

This application claims the benefit of priority to U.S. Provisional Application No. 61/772,190 filed on Mar. 4, 2013, all of which application is incorporated herein by reference in its entirety for all purposes.

TECHNICAL FIELD

The present invention relates generally to building construction and, more particularly, to insulated perimeter curbs and related safety rail systems installed on roofs, decks, and other like platform structures.

BACKGROUND OF THE INVENTION

In the building construction industry, there is often a need to construct curbs and safety rails along the perimeter of roofs, decks, and other like elevated platform structures.

Nowadays, metal framing assemblies are now commonly used in the building construction industry. Metal framing assemblies are generally constructed from a plurality of metal framing members including metal studs, joists, trusses, and other metal posts and beams some of which are formed from sheet metal (and frequently fabricated to have the same general cross-sectional dimensions as standard wood members used for similar purposes). Sheet metal framing members are typically constructed by roll-forming 10 to 24 gauge galvanized sheet steel. Although many cross-sectional shapes are available, the primary shapes used in building construction are C-shaped studs and U-shaped tracks.

Conventional building curbs are generally fabricated from standard metal or wood framing members, or some combination thereof, and are typically installed along the perimeter of a flat rooftop. As such, and because metal and wood framing members have poor insulative (thermal) properties, conventional curbs are generally sources of significant heat loss, unless insulation material is specially added after the perimeter curb has been installed. The additional step of adding insulation to a perimeter curb can be difficult and/or unfeasible, thereby generally increasing the overall cost of a construction project. In addition, the multiple pieces and weight of wood-made curbs makes them time consuming to construct on-site (multiple steps with many components and fasteners needed to construct and install).

Accordingly, and although some perimeter curb structures are known in the building construction trade, there is still a need in the art for new and improved rooftop perimeter curb structures that are easy to construct/install on-site. The present invention fulfills these needs and provides for further related advantages.

SUMMARY OF THE INVENTION

In brief, the present invention in one embodiment is directed to an innovative insulated perimeter curb structure positioned along the perimeter of a roof, a deck, or other like platform structure. The insulated perimeter curb is generally comprised of an upwardly facing U-shaped sheet metal receiving track fastened along the perimeter of the roof or deck. The receiving track includes a bottom web and a pair of spaced apart and upwardly extending sidewalls. The receiving track retains and holds a composite beam. In addition, a sheet metal cap (e.g., flat stock or C-shaped stud) is generally positioned on top of the composite beam. The innovative perimeter curb enables (i) the quick and integral construction of a temporary safety rail system, (ii) the construction of a concealed gutter system, and (iii) the construction of a cantilevered curb.

These and other aspects of the present invention will become more evident upon reference to the following detailed description and attached drawings. It is to be understood, however, that various changes, alterations, and substitutions may be made to the specific embodiments disclosed herein without departing from their essential spirit and scope.

BRIEF DESCRIPTION OF THE DRAWINGS

In the drawings like reference numerals are used to designate like features throughout the several views of the drawings.

DETAILED DESCRIPTION OF THE INVENTION

Figure 1:
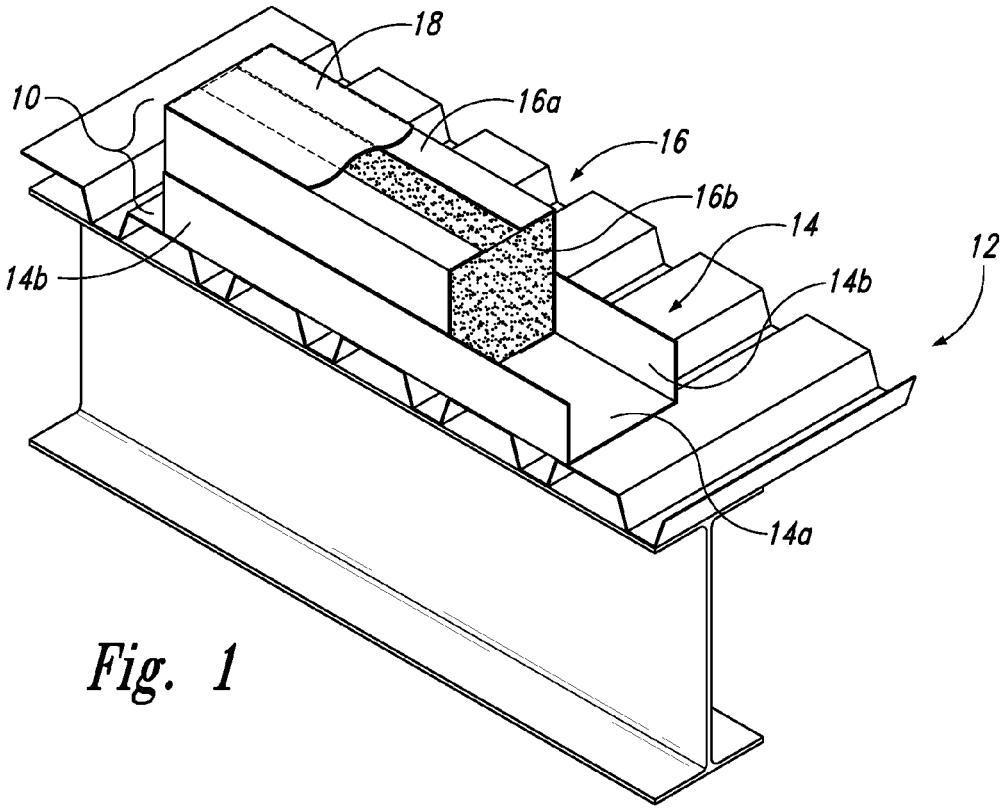
FIG. 1 is a front perspective partial view of an insulated perimeter curb in accordance with an embodiment of the present invention.
Figure 2:
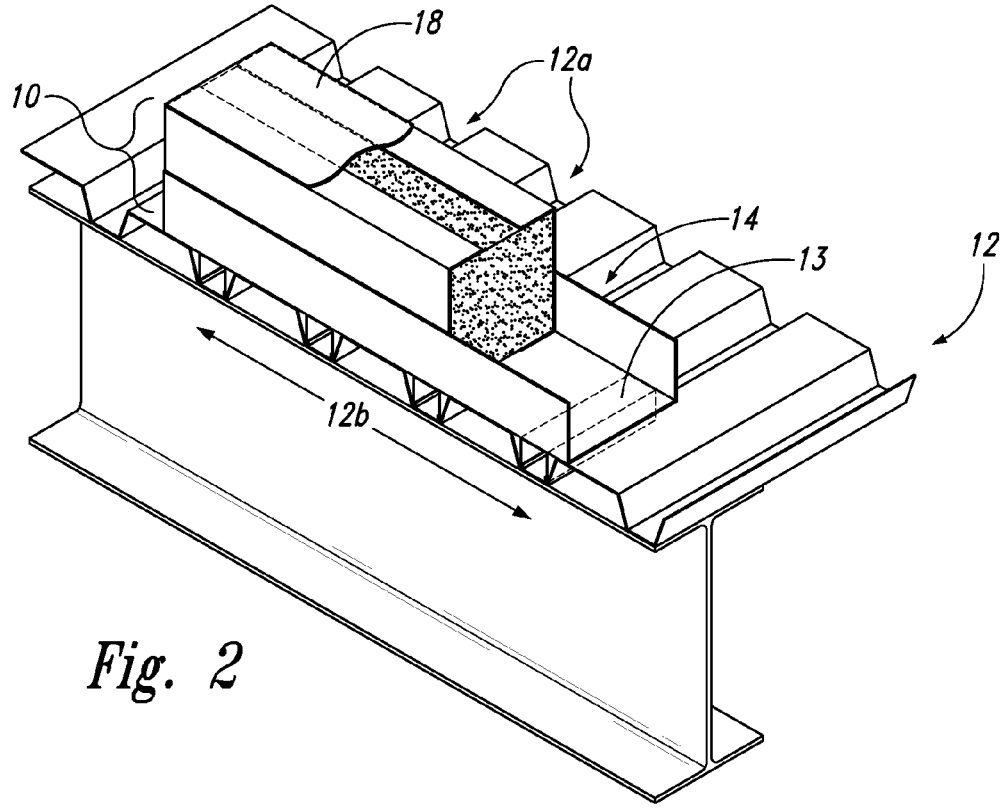
FIG. 2 is a front perspective partial view of an insulated perimeter curb in accordance with another embodiment of the present invention, whereby additional reinforcement members are added in recesses of a corrugated roof deck and beneath a capture (receiving) track.
Figure 3:
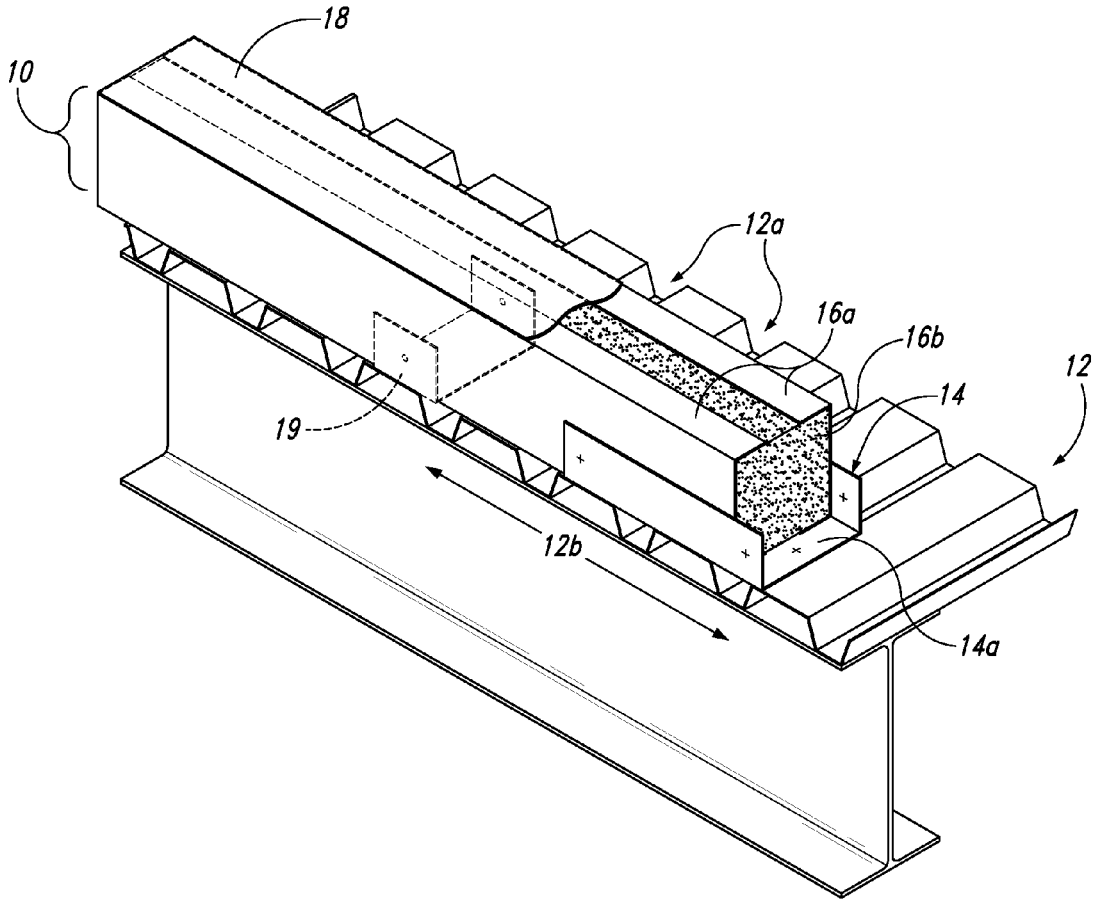
FIG. 3 is a front perspective partial view of an insulated perimeter curb in accordance with another embodiment of the present invention, whereby the capture (receiving) track component is partially segmented and one or more spacer elements (e.g., C-shaped elements made from 20 gauge steel) are positioned within the composite beam.

Referring now to the drawings wherein like references are used to designate like features and, more particularly, to FIGS. 1-9B, the present invention in one embodiment is directed to an innovative insulated perimeter curb 10 positioned along the perimeter of a roof, a deck, or other like platform structure 12. As shown in FIGS. 1-3 and in one embodiment, the insulated perimeter curb 10 is generally comprised of an upwardly facing U-shaped sheet metal receiving track 14 fastened along the perimeter of the roof or deck 12. The receiving track 14 includes a bottom web 14*a* and a pair of spaced apart and upwardly extending sidewalls 14*b*; and in some embodiments (e.g., FIG. 3) the upwardly extending sidewalls 14*b* may be notched (to reduce the amount of sheet metal material). As further shown in FIGS. 1-3, the receiving track 14 retains and holds a composite beam 16. In still further embodiments, the receiving track 14 may be pre-holed or marked at regular spaced apart intervals to facilitate attachment by means of fasteners (not shown).

In some embodiments and as shown in FIG. 2, the roof 12 is composed of corrugated sheet metal having a plurality of spaced apart grooves 12*a* that run substantially perpendicular to the edge 12*b* of the roof 12. A plurality of support blocks 13 may be positioned on a top surface of the corrugated sheet metal and within the plurality of spaced apart grooves 12*a* and along the lengthwise direction of the receiving track 14.

Figure 4:
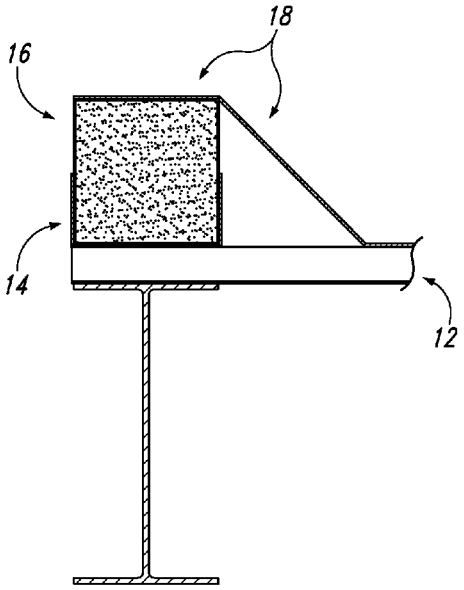
FIG. 4 is a side partial cross-sectional view of the insulated perimeter curb shown in FIG. 1.
Figure 5:
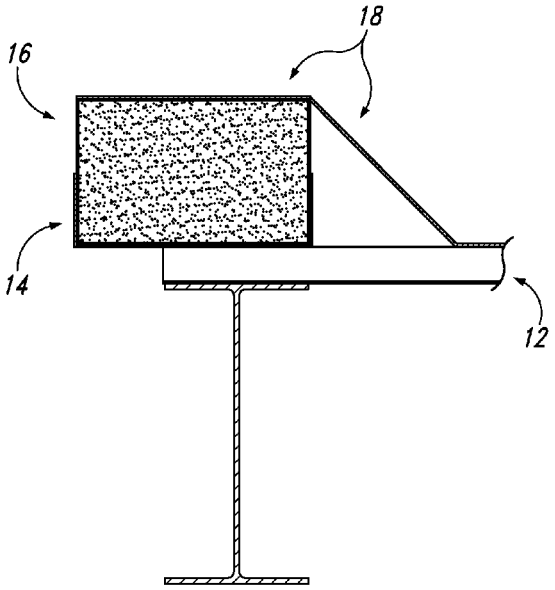
FIG. 5 is a side partial cross-sectional view of an insulated perimeter curb like the one shown in FIG. 1, but where the perimeter curb is wider and is cantilevered (overhanging) over the perimeter edge of a roof, a deck, or other like platform structure in accordance with an embodiment of the present invention.

In accordance with the present invention, the composite beam 16 is generally made of a pair of confronting C-shaped and/or U-shaped sheet metals studs 16*a* positioned about (1) a foamed polymer core 16*b* (e.g., a polystyrene, polyurethane, polypropylene, and/or a polyethylene foam), and/or (2) a mineral fiber core 16*b* (e.g., ROCKWOOL mineral wool insulation). In other words, the composite beam 16 consists generally or essentially of a pair of confronting C-shaped and/or U-shaped sheet metals studs 16*a* sandwiching a centrally positioned foamed polymer (plastic) and/or mineral fiber core 16*b*. The foamed polymer and/or mineral fiber core 16*b* serves as insulation for both heat and sound. The foamed polymer and/or mineral fiber core 16*b* is generally glued into place by use of a moisture cure urethane adhesive, which adds additional strength and durability. In addition, a sheet metal cap 18 (e.g., flat stock or C-shaped stud) is generally positioned on top of the composite beam 16. In some embodiments and as shown in FIGS. 4 and 5, the sheet metal cap 18 slopes downwardly from a top surface of the composite beam 16 to a top surface of the roof or deck 12 (and the composite beam 16 is generally of sufficient strength and rigidity to be substantially overhanging (cantilevered) as shown in FIG. 5). In other embodiments and as shown in FIGS. 7 and 8, the sheet metal cap 18 is a C-shaped stud that is positioned over the composite beam 16.

Figure 6:
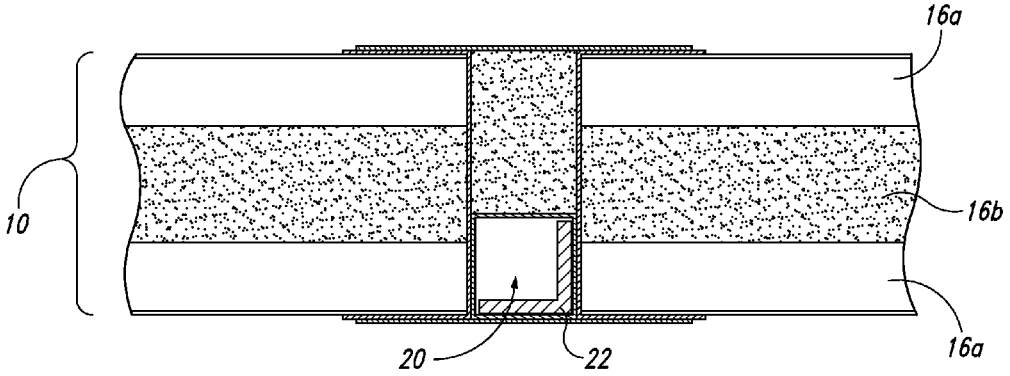
FIG. 6 is top partial view of an insulated perimeter curb having a reinforced integral post hole in accordance with an embodiment of the present invention.
Figure 7:
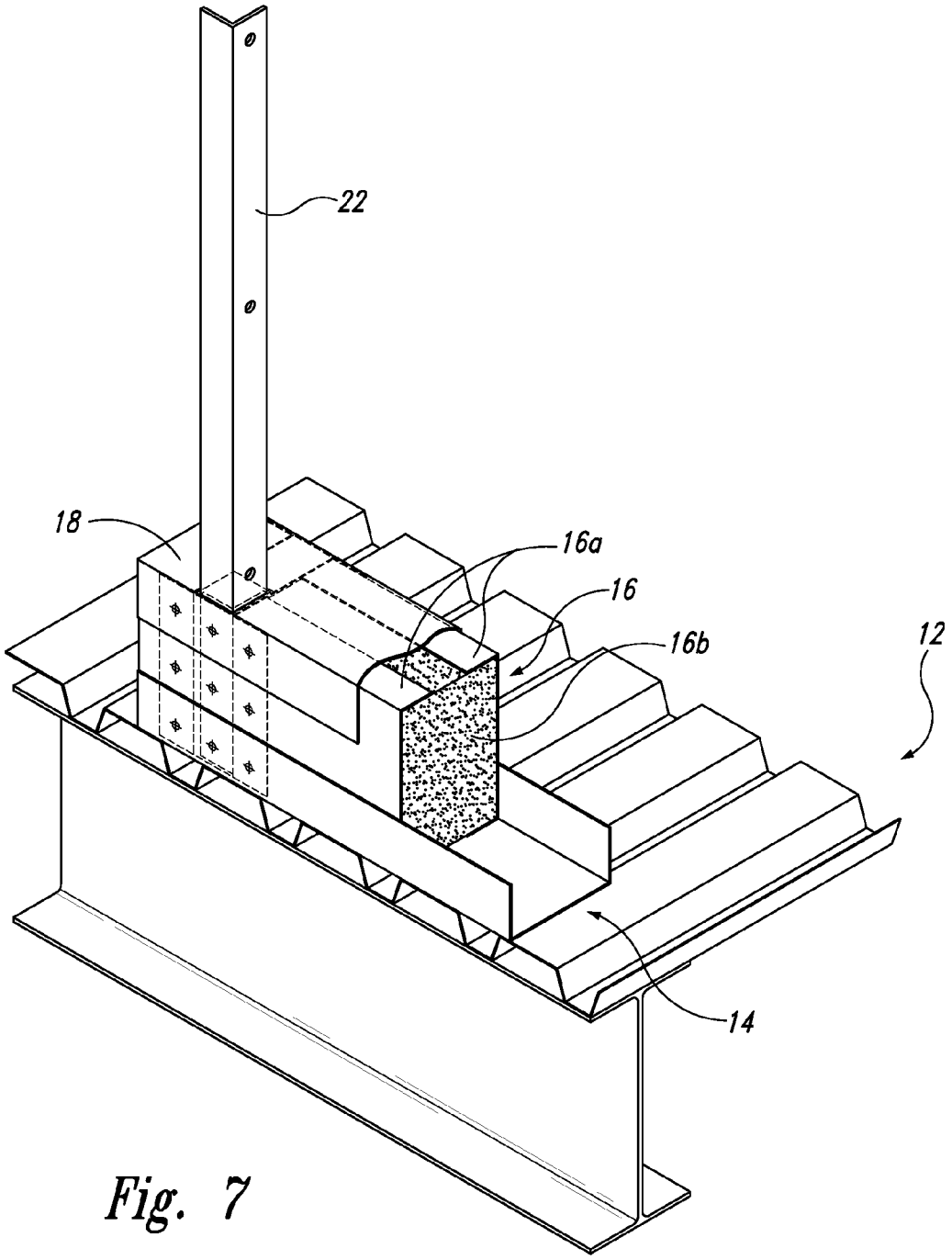
FIG. 7 is a front perspective partial view of an insulated perimeter curb having a straight angle member post (that forms part of a safety rail) in accordance with another embodiment of the present invention.
Figure 8:
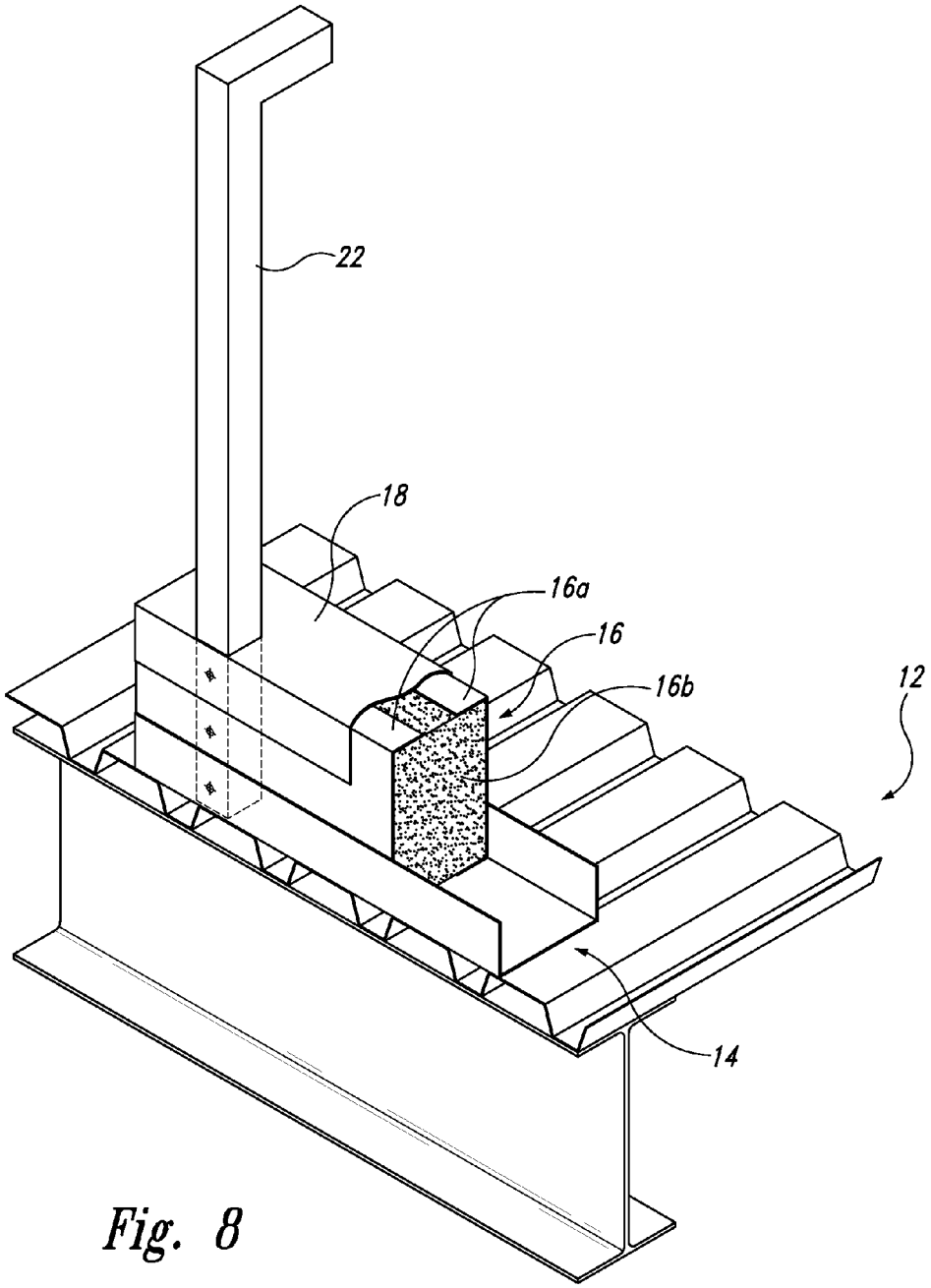
FIG. 8 is a front perspective partial view of an insulated perimeter curb having a different post (that forms part of a safety rail) in accordance with another embodiment of the present invention.

In still further embodiments and as shown in FIGS. 6-8, the innovative insulated perimeter curb 10 includes a plurality of reinforced post holes 20 (FIG. 6) for receiving a plurality of corresponding posts 22 (FIGS. 7 and 8). The plurality of posts 22 form part of a safety rail (not shown).

Figure 9A:
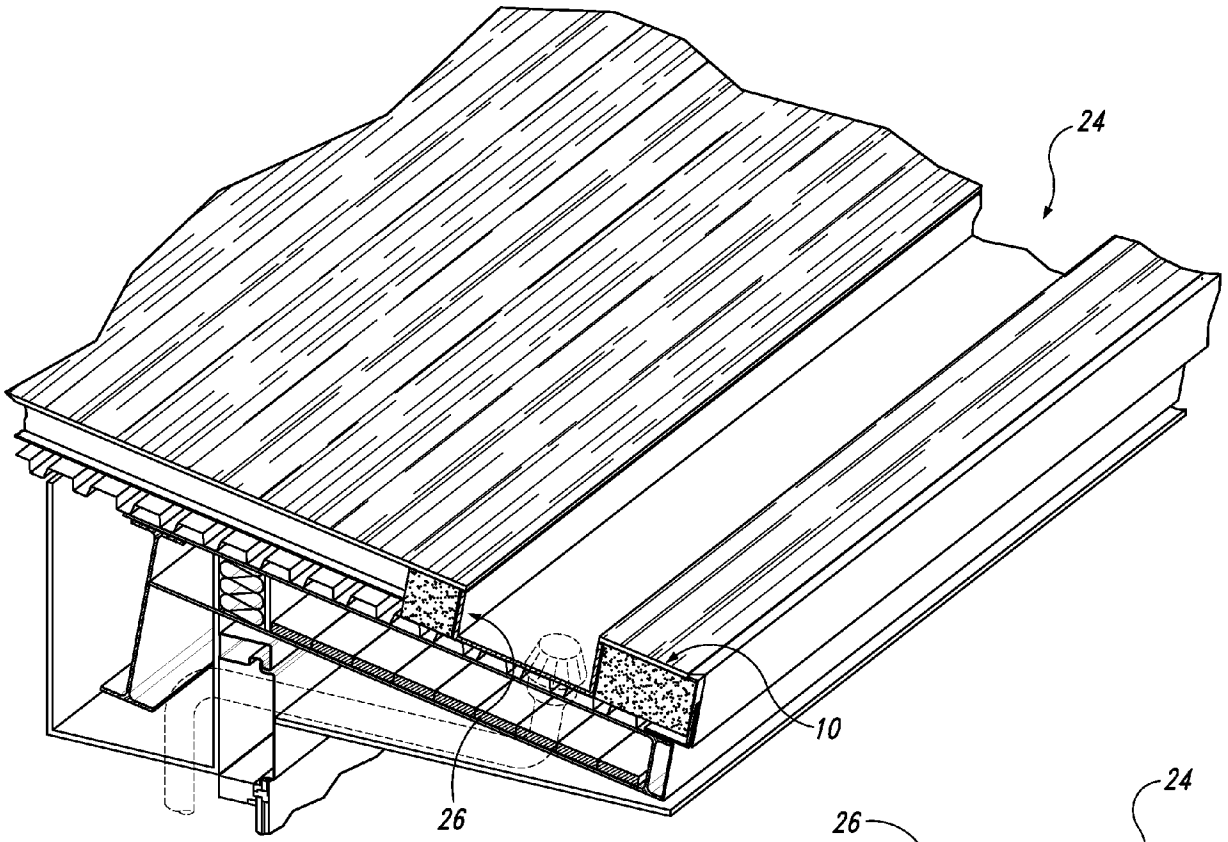
FIG. 9A is an elevated partial perspective view of a gutter positioned adjacent to an insulated perimeter curb and a perimeter roof beam constructed on a rooftop (or deck), whereby the gutter is hidden from a ground level view in accordance with another embodiment of the present invention.
Figure 9B:
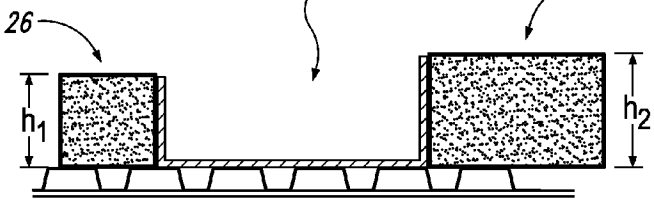
FIG. 9B is side cross-sectional view the concealed gutter system shown in FIG. 9A (which better illustrates that the height $h_1$ of the perimeter roof beam is less than the height $h_2$ of the perimeter roof curb).

In other embodiments and as best shown in FIGS. 9A-B, the innovative insulated perimeter curb is constructed on a rooftop (or deck) along with a concealed gutter (meaning that the gutter is not generally viewable (seen) from the perspective of a ground level observer). In the context of this embodiment, the insulated perimeter curb described above further comprises a gutter 24 defined by a perimeter roof beam 26 positioned adjacent (parallel) and spaced apart from the insulated perimeter roof curb 10. The perimeter roof beam 26 may be insulated and of the same general construction as the above described insulated perimeter roof curb 10. As shown, the height $h_1$ of the perimeter roof beam 26 is selected to be less than the height $h_2$ of the perimeter roof curb 10 (i.e., $h_1<h_2$). In other words, the dimensions of the perimeter roof curb 10 (e.g., 12 in.×7 in.) and the perimeter roof beam 26 (e.g., 6 in.×6 in.) may be chosen such that the height $h_1$ of the perimeter roof beam 26 is noticeably less than the height $h_2$ of the perimeter roof curb 10 (i.e., $h_1<h_2$). In this configuration, the gutter 24 is generally not viewable or seen (concealed) from the perspective of a ground level observer.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. In combination with a roof, an insulated perimeter roof curb comprising:

an elongated sheet metal receiving track positioned on the roof and proximate to an edge of the roof, wherein the receiving track is composed of a bottom web having a pair of spaced apart and upwardly extending sidewalls;

an elongated composite beam positioned within the receiving track and between the pair of spaced apart and upwardly extending sidewalls, wherein the composite beam is composed of an insulating core material sandwiched and glued between a pair of confronting C-shaped sheet metal tracks; and an elongated cover positioned on top of the composite beam.

2. The insulated perimeter curb of claim 1 wherein the pair of confronting c-shaped sheet metal tracks are a pair of confronting C-shaped sheet metal studs.

3. The insulated perimeter curb of claim 1 wherein the cover is a flat strip of sheet metal.

4. The insulated perimeter curb of claim 1 wherein the cover is a sheet metal cap track having a pair of spaced apart and downwardly extending sidewalls, and wherein the composite beam is positioned in the cap track and between the pair of spaced apart and downwardly extending sidewalls.

5. The insulated perimeter curb of claim 1 wherein the roof is composed of corrugated sheet metal having a plurality of spaced apart grooves that run substantially perpendicular to the edge of the roof, and wherein the insulated perimeter curb further comprises a plurality of support blocks positioned on a top surface of the corrugated sheet metal and within the plurality of spaced apart grooves and along the lengthwise direction of the receiving track.

6. The insulated perimeter curb of claim 1 wherein the insulating core material is a foamed polymer.

7. The insulated perimeter curb of claim 1 wherein the insulating core material comprises a mineral fiber.

8. The insulated perimeter curb of claim 1 wherein the elongated sheet metal receiving track is cantilevered relative to the edge of the roof.

9. The insulated perimeter curb of claim 8 wherein the perimeter roof curb contains an insulating material.

10. The insulated perimeter curb of claim 1, further comprising one or more spacer elements positioned within the composite beam.

11. The insulated perimeter curb of claim 1, further comprising a gutter defined by a perimeter roof beam positioned adjacent and spaced apart from the insulated perimeter roof curb, wherein the height of the perimeter roof beam is less than the height of the perimeter roof curb.

12. The insulated perimeter curb of claim 11, further comprising a plurality of post holes having received therein a plurality of corresponding posts that form part of a safety rail.

13. The insulated perimeter curb of claim 1, further comprising a plurality of post holes having received therein a plurality of corresponding posts that form part of a safety rail.

* * * * *